US005649424A

United States Patent [19]

Valavaara

[11] Patent Number: 5,649,424

[45] Date of Patent: Jul. 22, 1997

[54] TWO-STAGE PRESSURE CYLINDER

[76] Inventor: Viljo K. Valavaara, 3939 Lawrence Avenue East, Toronto Ontario, Canada, M1E 1R9

[21] Appl. No.: 646,370

[22] PCT Filed: Nov. 8, 1994

[86] PCT No.: PCT/CA94/00619

§ 371 Date: May 7, 1996

§ 102(e) Date: May 7, 1996

[87] PCT Pub. No.: WO95/13478

PCT Pub. Date: May 18, 1995

[30] Foreign Application Priority Data

Nov. 9, 1993 [CA] Canada ..... 2102762

[51] Int. Cl.[6] ..... F15B 7/00

[52] U.S. Cl. ..... 60/560; 60/567; 60/574; 60/581

[58] Field of Search ..... 60/549, 560, 563, 60/565, 567, 574, 581, 583

[56] References Cited

U.S. PATENT DOCUMENTS

| | | | |
|---|---|---|---|
| 2,601,761 | 7/1952 | Fouron . | |
| 2,915,878 | 12/1959 | Hramoff | 60/565 |
| 4,011,724 | 3/1977 | Landes et al. | 60/567 |
| 4,072,013 | 2/1978 | Barbareschi | 60/560 |
| 4,288,987 | 9/1981 | Grullmeier . | |
| 5,381,661 | 1/1995 | Malina | 60/560 |

FOREIGN PATENT DOCUMENTS

| | | | |
|---|---|---|---|
| 178613 | 3/1962 | Sweden | 60/574 |

*Primary Examiner*—F. Daniel Lopez

[57] ABSTRACT

A two-stage pressure cylinder having a work cylinder (17, 100) with a work piston (18,108), and piston rod (20,110) for contact with a work piece, in which the work piston is movable, an oil cylinder (56,116) to contain hydraulic fluid (H), an oil piston (58,118) in the oil cylinder, an air cylinder (72,122), an air piston (74,124) in the air cylinder, and an air piston rod (80,126) connected to the air piston and communicating with the hydraulic fluid, and valves allowing hydraulic fluid to pass from the oil cylinder to the work cylinder to operate the work piston, and on a reverse stroke flow being operable to permit return flow of fluid from the work cylinder into the oil cylinder.

10 Claims, 4 Drawing Sheets

TWO-STAGE PRESSURE CYLINDER

TECHNICAL FIELD

The invention relates to a two-stage pressure cylinder of the type in which a low pressure fluid provides an initial degree of movement of a work piston and the low pressure is subsequently intensified to provide a high pressure on the work piston for application to a work piece.

BACKGROUND ART

Two-stage pressure systems have been proposed for many applications. One particular application is the use of pressure systems as welding clamps, for the spot welding of metals.

There are numerous other applications are available for a two-stage type pressure cylinder.

One form of two-stage clamping cylinder has been proposed in U.S. Pat. Nos. 3,875,365, 3,828,652, 4,099,436 and 4,135,076.

In this system the hydraulic fluid is located in a holding tank in a separate location, and is connected by hoses to a work cylinder.

However this system does have certain disadvantages. Each work cylinder must be provided with its own hydraulic fluid tank and system of hoses, and the tank must be capable of receiving a pressure from an air pressure source.

French Patent 2,384,977 shows a two-stage air-hydraulic cylinder. The cylinder has a work piston, an oil piston and an intensifier piston.

However, the operating system for the cylinder is a complex system of air chambers, controlled by needle valve at the top of the cylinder on the left hand side of FIG. 1. The intensifier piston 26 must be all the way to the left in order for these needle valves to operate. So long as the intensifier piston 26 is kept at the left hand end, then oil can flow from the oil cylinder 21 through the chamber 13 into the working cylinder.

However, if there is any malfunction of the needle valves caused by dirt or any other means, so that the intensifier piston 26 does not reach all the way back to the left, then no oil flow can take place since the cylinder rod 15 will close off the passage 13.

There is no disclosure of a first valve allowing oil to flow into the working cylinder on a working stroke and preventing its return flow.

There is no disclosure of a second valve which is normally closed to prevent return flow, and which is operable to permit return flow, for a return stroke of the working piston.

German Patent 3,345,002 discloses a two-stage cylinder. There are only two pistons namely, a work piston and an intensifier piston. Oil is apparently contained in the work cylinder, and is in some way forced upwardly by means of air in the conduit 19 and the spring 13. Apparently, this movement will cause the initial downward movement of the work piston until it touches the workpiece.

There is no disclosure of a first valve normally operable to permit flow of oil from an oil cylinder into the working cylinder, and being closed to prevent reverse flow.

There is no disclosure of a valve which is normally closed to prevent reverse flow, but which is operable to open and permit reverse flow of the oil for a return stroke of the work piston.

DISCLOSURE OF THE INVENTION

The invention seeks to provide an improved two-stage pressure cylinder apparatus having a main cylinder, a work piston, and work piston rod movable within said main cylinder, and said work piston rod being adapted to extend therefrom for contact with a work piece, an oil cylinder adapted to contain hydraulic fluid, an oil piston in said oil cylinder movable therein towards and away from said main cylinder, an air cylinder, an air piston in said air cylinder, and an air piston rod of reduced diameter in relation to said air piston, communicating with said hydraulic fluid, working stroke fluid flow valve means allowing hydraulic fluid to pass from said oil cylinder to said main cylinder, and a reverse flow valve means, operable to permit return flow of fluid from said main cylinder into said oil cylinder.

The invention further provides air pressure conduits connecting with said main cylinder, and, in which the work piston and piston rod incorporate a fluid chamber, the air piston rod being movable into and out of the fluid chamber.

The invention further provides that the main cylinder, oil cylinder, and air cylinder are formed as a single integral continuous cylindrical structure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

MODES OF CARRYING OUT THE INVENTION

Figures 1, 1A:
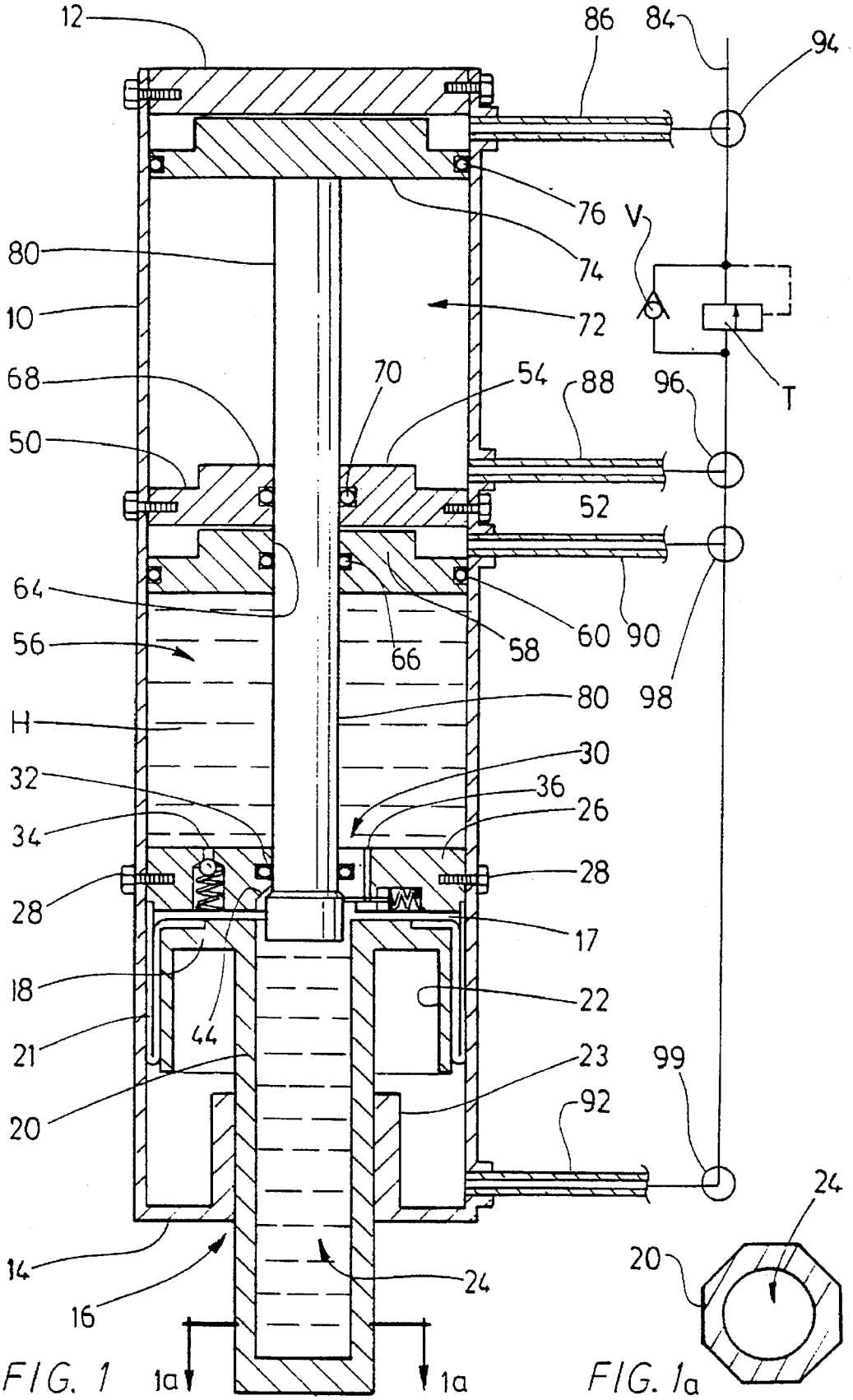
FIG. 1 is a schematic sectional side elevation of a two-stage pressure cylinder apparatus according to the invention.
FIG. 1A is a section along line 1A—1A of FIG. 1.

Reviewing first of all FIG. 1, it will be seen that the two stage cylinder apparatus according to the invention is illustrated in somewhat schematic form, it being appreciated that in the finished engineered form there would be numerous changes of an engineering nature which do not in any way depart from the scope of the invention.

Thus, for example, the cylinder apparatus is shown as an essentially integral chamber which might, as described below be made in various parts so that they could be assembled together. Certain of the pistons and piston rods are shown as integral structures simply for the sake of clarity. The pneumatic lines are shown as lines, for the sake of simplicity. A cylinder structure is shown as 10, having a removable top plate 12 and a bottom wall 14. The upper and lower portions could be made separate from one another.

The lower wall 14 has a central opening 16 which in this case is of octagonal shape (FIG. 1A) and defines the lower end of a working or main cylinder 17. A working piston 18 is slidably received in the working cylinder 17, and has a working piston rod (of octagonal shape) 20 extending therefrom through opening 16. These shapes prevent rotation of the working piston rod during operation, and are still relatively easy to seal. Other shapes could be used for these purposes.

Suitable seals (not shown), typically O-rings, are provided as needed.

Preferably the piston 18 has a flexible sealing membrane 21 such as a "Bellofram" (trade mark) seal. A skirt 22 on piston 18 is provided to locate the membrane 21.

The working piston rod 20 is guided in octagonal bushing 23, and at least along part of its length, is hollow, and defines a generally cylindrical interior recess 24, for reasons described below (FIG. 1A).

A first or lower partition wall 26 is fastened within cylinder structure 10 by any suitable means and together with lower end 14 of cylinder structure 10 defines the working cylinder 17. Bolts 28 are illustrated purely for the sake of example. Partition wall 26 has a central opening 30, provided with suitable seals 32.

Figure 2:
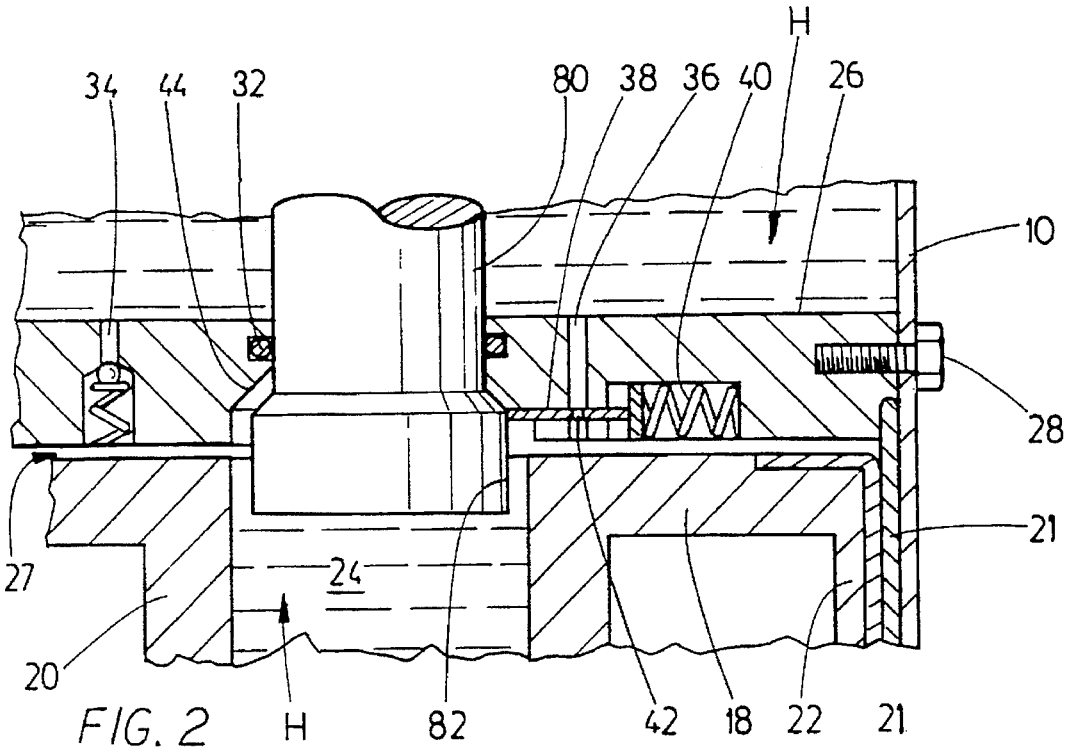
FIG. 2 is a greatly enlarged sectional illustration of a portion of FIG. 1 at a first stage of its operation with the intensifier piston at its up position.
Figure 3:
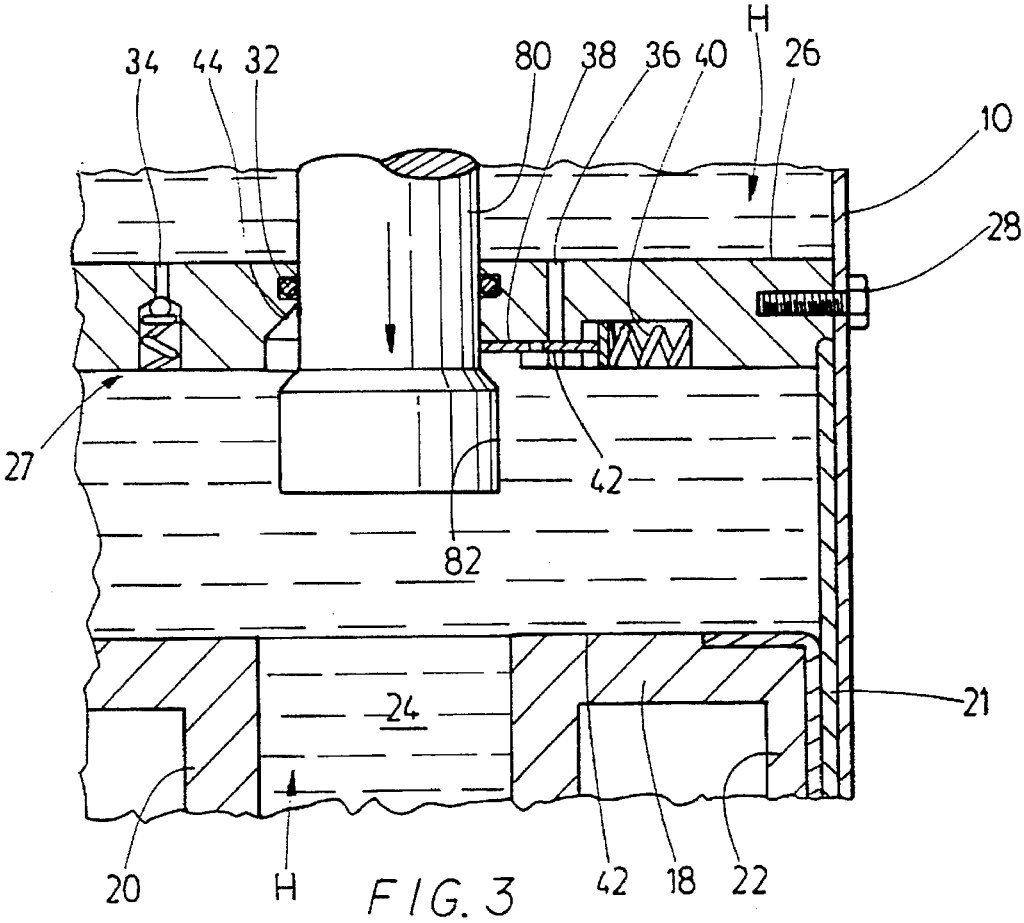
FIG. 3 is a view corresponding to FIG. 2 at a second position in its operation with the intensifier piston just beginning its down stroke.

A working stroke flow passageway, and valve 34, are provided in partition 26. Valve 34 permits flow of hydraulic fluid downwardly through partition wall 26 into work cylinder 17. A reverse flow passageway 36 may be provided in partition wall 26. Such a passageway 36 is provided with valve means such as a valve plate 38 which is slidable in partition wall 26 against spring 40 (FIG. 2).

Valve plate 38 has an opening 42. Sliding of valve plate 38 against spring 40 will move opening 42 into registration within passageway 36.

Valve 34 could also provide for flow in both directions. provided some suitable means of operation can be provided for the valve so that it may operate to permit flow in both directions.

First partition wall 26 has with a counter bore 44.

The valve plate 38 extends partially into counter bore 44.

Spaced a distance above lower partition wall 26, is a second or upper partition wall 50, as fastened in position by bolts 52. It has a raised central portion 54 of reduced diameter, providing a stop member.

The second partition wall 50 together with first partition wall 26 define between them an oil cylinder indicated generally as 56. Within oil cylinder 56 a sliding oil piston 58 is provided, having suitable seals 60. Piston 58 has a raised central stop portion 62, and a central axial opening 64 provided with seals 66.

Partition 50 also has a central opening 68, provided with seals 70.

Second partition 50, together with the top closure plate 12 of the cylinder apparatus 10 define between them an air cylinder 72. Within air cylinder 72 an air piston 74 is slidably movable. Air piston 74 has seals 76, and a raised central stop portion 78.

An elongated air piston rod 80 extends downwardly from air piston 74 passing through openings 68, 64 and 30.

Air piston rod 80 extends into the recess 24 defined by the work piston rod 20. Air piston rod 80 is of reduced diameter relative to recess 24 and does not seal in it. A valve operating cam 82 is formed on the lower end of air piston rod 80 to operate valve plate 38.

A main air pressure supply line 84 is provided with four branch connections 86, 88, 90 and 92, each of which is respectively provided with respective valves 94, 96, 98 and 99. The valves are operable to provide on-off flow of compressed air, or to vent air to atmosphere in a predetermined sequence.

An air pressure regulator and timer T, and valve V are provided in line 84, between valves 94 and 96, which are adjustable as desired, so as to vent air above a pressure, which may be adjusted by the regulator T.

The controls may be mechanical, electrical or hydraulic or pneumatic. Branch 86 supplies air cylinder 72 above piston 74. Branch 88 supplies air cylinder 72 below piston 74 (for return). Branch 90 supplies a cylinder 56 above piston 58. Branch 92 supplies work cylinder 17 below piston 18 (for return).

The portion of oil cylinder 56 between piston 58 and partition 26 is filled with hydraulic fluid indicated generally as H. Similarly, hydraulic fluid H fills the valve passageways 34 and 36, and the upper portion of main cylinder 17 between partition 26 and piston 18, and also fills the recess 24 of piston rod 20.

It will also be noted that the lower end 82 of piston rod 80 does not make a snug fit with the interior of recess 24, in this illustration.

Lower portion of the working cylinder 17 contains air. Oil cylinder 56, above oil piston 58 also merely contains air. Air cylinder 72 contains air both above and below air piston 74.

Figure 4:
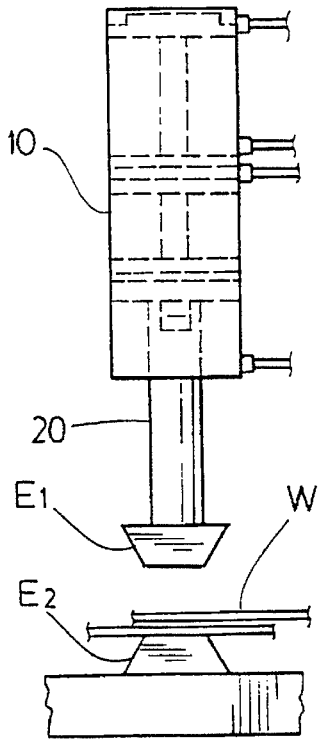
FIGS. 4, 5 and 6 are reduced scale schematic views of the apparatus at different stages of its operation.
Figure 5:
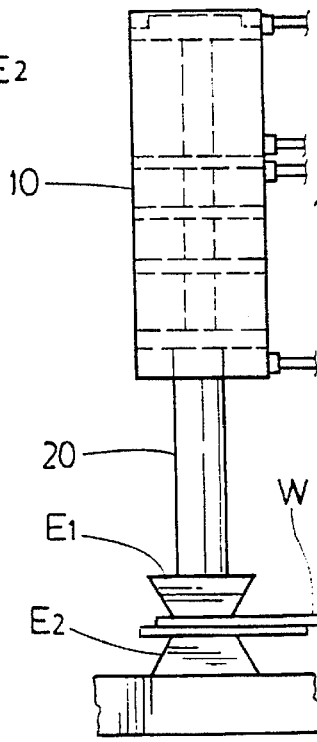
Figure 6:
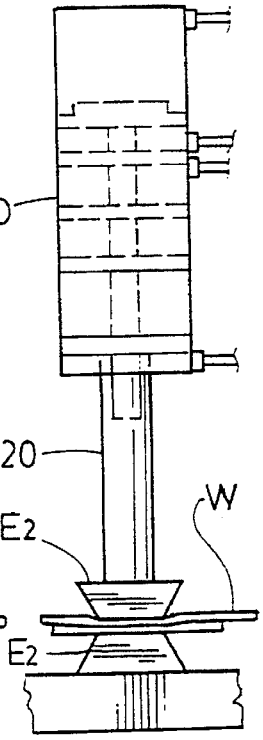

In operation, the device will initially be in its raised inoperative position as shown in FIGS. 1, 2 and 4.

Figure 7:
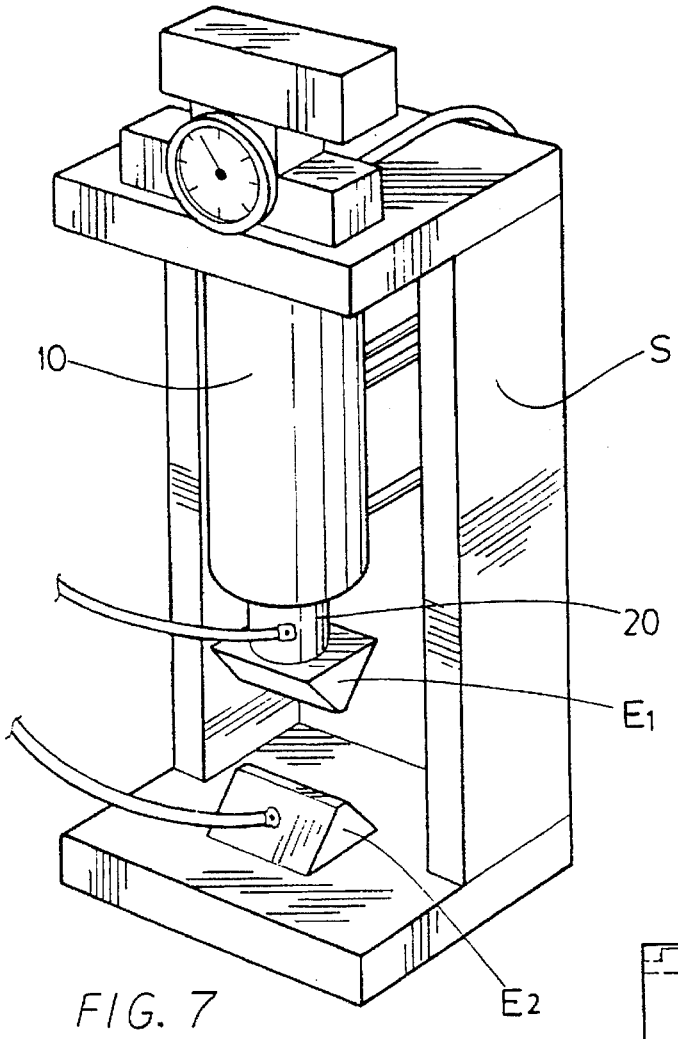
FIG. 7 shows the apparatus set up in a representative welding application, and, FIG. 8 illustrates an alternate embodiment, with exterior valving.

Working piston rod 20 may carry any suitable form of tool, which may be a die, or a spot welding electrode or merely some form of clamping plate if some other form of clamp. FIG. 7 shows a spot welding application. The cylinder apparatus 10 is shown in a support S, and electrodes E1 and E2 are shown, with E1 mounted on rod 20.

Air is supplied by branch 90 and valve 98 to the upper surface of oil piston 58, typically be relatively low, between about 60 to 120 pounds per square inch.

This will force oil piston 58 downwardly in oil cylinder 56, and cause the hydraulic fluid H to flow downwardly through valve 34 and also through passageway 36 which at this point is still open (FIG. 2), into the upper portion of work cylinder 17 above work piston 18.

This will thus cause work piston 18 and work piston rod 20 to move downwardly.

This first movement carries the parts through the so called "dead space" in which the upper tool or die is generally, but no work is done on a work piece.

Once the tool on work piston rod 20 contacts the work piece, the work piece will temporarily stop movement, since the relatively low pressure of the air is not sufficient to develop a substantial force.

By controls (not shown) the air is then supplied through branch 86 and valve 94 to the upper surface of air piston 74.

This will now cause air pressure intensifier piston 74 and intensifier piston rod 80 to move downwardly. As piston rod 80 moves downwardly the cam 82 releases slide valve 38. Spring 40 then causes valve 38 to close passageway 36.

The lower end of air piston rod 80 will thus be forced downwardly through partition 26, into the recess 24. Oil cannot escape upwardly since valve 34 is a one way flow valve and valve passageway 36 is closed.

As a result a pressure intensification is caused which is directly proportional to the difference in cross-sectional area between the air intensifier piston 74, and the cross-sectional area of the air intensifier piston rod 80.

This intensified pressure is applied to the whole upper surface area of work piston 18. This pressure is thus in turn applied as force to the much smaller surface area of the tool on work piston rod 20.

It is possible in this way to achieve a pressure intensification of between ten and twenty times.

By this pressure intensification, it is thus possible, with the use of relatively low pressure compressed air to develop a high clamping force on the tool which has a much smaller cross-sectional area than the working piston 18 and thus the work piece.

Assuming that the cylinder is being used for spot welding, the electrical discharge is released at or just prior to this time. The current passes through the work piece heating it to the welding temperature.

The progressively increasing clamping force will cause the tool to move a slight distance into the work piece, causing a forging of the work piece.

The controls then cause reverse movement of the parts, to the position illustrated in FIG. 4.

In this operation, the valves 94 and 98 are operated so as to vent air from the upper portion of air cylinder 72 and oil cylinder 56 to atmosphere. The valve 96 is then operated to cause the air piston 74 to rise.

As it reaches its top position, the cam 82 on work piston rod 80 will contact the inwardly extending portion of valve plate 38, causing it to slide against spring 40, opening 42 will register with passageway 36.

At about the same time the valve 99 is operated to apply air pressure to the underside of work piston 18 causing piston 18 to rise upwardly once more, thereby causing fluid to flow upwards through opening 42 in valve plate 38 and passageway 36.

The entire system is then ready to be cycled again.

As mentioned, suitable automatic controls, timers, and gauges where provide automatic operation.

A separate cylinder apparatus is used for each pair of electrodes, and each cylinder can be provided with pressure regulator and timing controls T, so that the clamping force and discharge current timing, can all be controlled totally automatically, and may be preset for each particular welding function.

The quality of each spot weld will be improved, and the life of the electrodes will be increased, and also the current consumption reduced.

Figure 8:
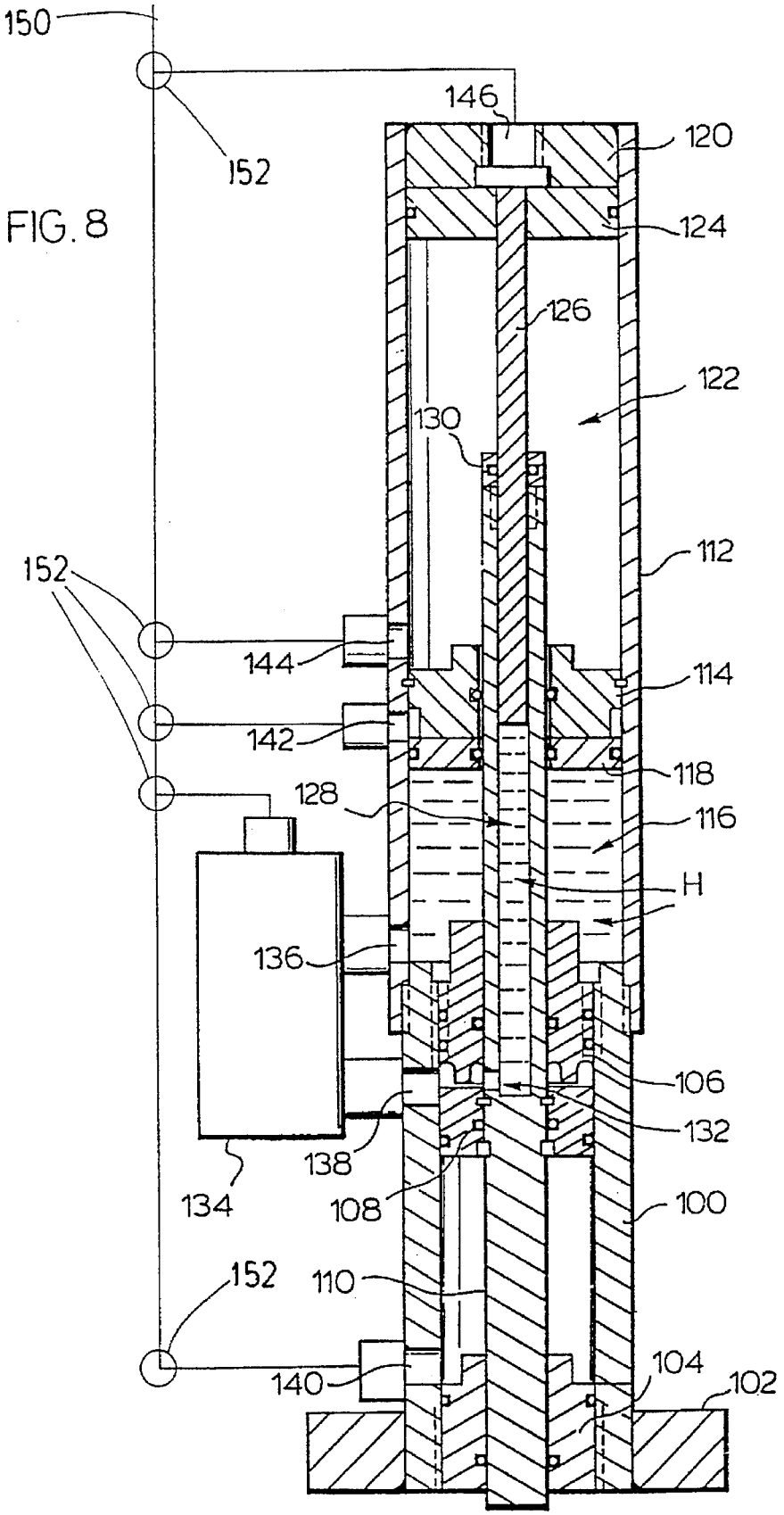

In the FIG. 8 embodiment a working cylinder 100 is mounted on a base plate 102, and has an end bearing block 104. A top closure block 106 closes the top end of working cylinder 100. A working piston 108 is mounted on a working piston rod 110, which is slidably received in block 104.

An upper two-stage cylinder barrel 112 is mounted on the upper end of working cylinder 100. The two-stage cylinder 112 is separated internally by a separation block 114, defining a lower oil cylinder 116. An oil piston 118 is moveable within oil cylinder 116, by air pressure in a manner described below, that essentially similar to the embodiment of FIGS. 1 through 7.

The upper end of cylinder 112 is closed by closure block 120, which thus defines an upper air cylinder 122.

An air piston 124 is slidable within air cylinder 122.

Piston 124 is mounted on intensifier piston rod 126.

Intensifier piston rod 126 is slidable within an intensifier cylinder 128, which extends from the upper end of working piston rod 110 through block 106, and through block 114 up into a point midway into air cylinder 122.

At its upper end 130 cylinder 128 is provided with a seal to seal on intensifier piston rod 126.

At its lower end cylinder 128 is provided with one or more ports 132, which communicate with the upper end of working cylinder 100.

An oil supply and return valve 134 is connected by port 136 to oil cylinder 116 and by port 138 to working cylinder 110, above piston 108.

When valve 134 is open, oil can be transferred from oil cylinder 116 through valve 134 to working cylinder 110, and will cause rapid, low pressure movement of piston rod 110 towards a work piece.

An air line connection 140 is provided at the lower end of working cylinder 100, for return of movement.

Air supply 142 supplies air to the upper end of oil cylinder 116 above piston 118. Air supply 144 supplies air to the lower end of air cylinder 122, and air supply 146 supplies air to the upper end of cylinder 122 above piston 124.

The air control valve is 134 essentially the same in function as in the embodiment of FIG. 1, except that the valve 134, instead of being located internally within the cylinders, is located externally in this example and is operated also by air.

Main supply line 150 supplies air pressure through valves 152.

In the operation of this embodiment, air is supplied first of all to port 142, causing oil piston 118 to move downwardly. Oil passes from cylinder 116 through port 136 and valve 134, which is open at this point, through put 138 to the upper end of the cylinder 100. This will cause rapid movement of work piston rod 110 down into contact with the work piece.

Controls (not shown) will then shut off air to the port 142 and will also cause operation of valve 134 to close off the flow of oil, and also the return flow of oil. Air will then be supplied through supply port 146 to the upper end of air cylinder 122, driving piston rod 126 downwardly through intensifier cylinder 128. This will force oil downwardly through ports 132, into the upper end of working cylinder 100.

Pressure intensification caused by the difference in area between the piston 124 and the piston rod 126 will force piston rod 110 against the work piece at a much higher pressure, thereby doing work.

On the return stroke the operation of the air valves will thus open oil valve 134 to allow return flow of oil, and will supply return air to ports 144, and 140, causing the respective pistons 108, 118, and 124, to rise upwardly once more.

In this embodiment it will be observed that the wall thickness of the working cylinder 100 can be made much greater than the dimensions of the air and oil cylinders 122.

Intensifier cylinders 112 can be provided in a range of dimensions, with suitable adapters (not shown) adapting them to fit a standard range of working cylinders 100.

The foregoing is a description of a preferred embodiment of the invention which is given here by way of example only. The invention is not to be taken as limited to any of the specific features as described, but comprehends all such variations thereof as come within the scope of the appended claims.

I claim:

1. A two-stage pressure cylinder apparatus having working cylinder means (17); a work piston (18), and work piston rod (20) movable within said working cylinder means, said work piston rod being adapted to extend therefrom for a working stroke; oil cylinder means (56), adapted to contain hydraulic fluid (H) connected to said working cylinder means; an oil piston (58) in said oil cylinder means; means (26) separating said oil cylinder means from said working cylinder means and defining axial opening means; pneumatic cylinder means (72) connected to said working cylinder means; pneumatic piston means (74) in said pneumatic cylinder means (72), and a piston rod (80) connected to said pneumatic piston means and communicating through said axial opening in said means separating said oil cylinder means and said working cylinder means with said working cylinder means (17) and operable by said pneumatic piston means for intensifying the pressure of said hydraulic fluid (H) in said working cylinder means and being characterised by, first valve means (34) enclosed within said means separating said oil cylinder means from said working cylinder means and being normally operable to allow hydraulic fluid to pass from said oil cylinder means (56) under the influence of said oil piston (58) to said working cylinder means (17) for causing movement of said work piston (18) and said first valve means being operable to prevent reverse flow of said hydraulic fluid, during a work stroke of said work piston;

second valve means (36) enclosed within said means separating said oil cylinder means from said working cylinder means and being normally positioned to prevent return flow of hydraulic fluid from said working cylinder means to said oil cylinder means, and being moveable after completion of said work stroke of said work piston to open and permit return flow of said hydraulic fluid to said oil cylinder means through said second valve means;

pressurized pneumatic supply means (84) connected with said oil cylinder means and said pneumatic cylinder means;

control means (94,96,98,99) for said pneumatic supply means for causing operation of said oil piston and said pneumatic piston means on a work stroke and, for causing return of said work piston and said piston rod and said pneumatic piston after a work stroke, and, second valve operating means (82) on said piston rod adapted to contact said second valve means within said means separating said oil piston means and said working cylinder means during said return of said piston rod and cause operation of said second valve means.

2. A two-stage pressure cylinder apparatus as claimed in claim 1 including pneumatic pressure conduits (86,88,90,92) connecting with said oil and pneumatic cylinder means whereby to procure operation of said oil piston, and said pneumatic piston, and return movement of said work piston in sequence.

3. A two-stage pressure cylinder apparatus as claimed in claim 1 wherein said work piston and work piston rod incorporate a fluid chamber (24), and said pneumatic piston rod is movable into and out of said fluid chamber.

4. A two-stage pressure cylinder apparatus as claimed in claim 1 wherein said oil cylinder means (56) is formed integrally with said working cylinder means (17).

5. A two-stage pressure cylinder apparatus as claimed in claim 4, and wherein said pneumatic cylinder means (72) is formed integrally with said oil cylinder means (56) and with said working cylinder means (17).

6. A two-stage pressure cylinder apparatus as claimed in claim 5 wherein said working cylinder means (17) said oil cylinder means (56) and said pneumatic cylinder means (72) are formed out of a single integral cylindrical structure (10), and, partition means (26,50) located at spaced intervals within said cylindrical structure separating the same into said working cylinder means (17) said oil cylinder means (56) and said pneumatic cylinder means (72).

7. A two-stage pressure cylinder apparatus as claimed in claim 1, and wherein partition means (50) separates said oil cylinder means from said pneumatic cylinder means, and including axial opening means (64) extending through said second partition means, and wherein said intensifier piston rod (80) passes through said axial opening means, from said pneumatic cylinder means to said working cylinder means.

8. A two stage pressure cylinder apparatus as claimed in claim 1 and wherein said second valve operating means (82) comprises a cam (82) on said intensifier piston rod (80), which contacts and operates said second valve means (42) upon movement of said intensifier piston rod on its return stroke.

9. A two-stage pressure cylinder apparatus having working cylinder means (100); a work piston (108), and work piston rod (110) movable within said working cylinder means, said work piston rod being adapted to extend therefrom for a working stroke; oil cylinder means (116), adapted to contain hydraulic fluid (H) connected to said working cylinder means; an oil piston (118) in said oil cylinder means; pneumatic cylinder means (122) connected to said working cylinder means; pneumatic piston means (124) in said pneumatic cylinder means (122), and an intensifier piston rod (126) connected to said pneumatic piston means and communicating with said working cylinder means (100) for intensifying the pressure of said hydraulic fluid (H) therein; and being characterised by, two way valve means (134) operable to allow hydraulic fluid to pass from said oil cylinder means (116) under the influence of said oil piston (118) to said working cylinder means (100) for causing movement of said work piston (108) and being operable to prevent reverse flow, during a work stroke thereof, and being operable after completion of said work stroke to permit return flow of said fluid to said oil cylinder means;

pressurized pneumatic supply means (150) connected with said oil cylinder means and said pneumatic cylinder means;

control means (152) for controlling said pneumatic supply means and said two way valve means for operation of said oil piston and said pneumatic piston means on a work stroke and, operable to return said work piston and said pneumatic piston after a work stroke, and, an intensifier cylinder means (128) connecting with said working piston means (108), and extending upwardly into said pneumatic cylinder means, and said intensifier piston rod (126) extending into said intensifier cylinder means (128).

10. A two-stage pressure cylinder apparatus as claimed in claim 9 and wherein said two way valve means (134) communicates between said working cylinder means and said oil cylinder means, and and wherein said valve operating means (150,152) operates said two way valve means whereby to communicate oil from said oil cylinder means to said working cylinder means at one stage, and to shut off communication in another stage and to permit return of said oil from said working cylinder to said oil cylinder at another stage.

* * * * *